US008925207B2

(12) United States Patent
Kärnä

(10) Patent No.: US 8,925,207 B2
(45) Date of Patent: Jan. 6, 2015

(54) AXE

(76) Inventor: Heikki Kärnä, Västerskog (FI)

( * ) Notice: Subject to any disclaimer, the term of this patent is extended or adjusted under 35 U.S.C. 154(b) by 404 days.

(21) Appl. No.: 13/265,632

(22) PCT Filed: Apr. 23, 2010

(86) PCT No.: PCT/FI2010/050334

§ 371 (c)(1),
(2), (4) Date: Oct. 21, 2011

(87) PCT Pub. No.: WO2010/122230

PCT Pub. Date: Oct. 28, 2010

(65) Prior Publication Data

US 2012/0036723 A1 Feb. 16, 2012

(30) Foreign Application Priority Data

Apr. 24, 2009 (FI) ..... 20095455

(51) Int. Cl.
*B26B 23/00* (2006.01)
*B25G 3/02* (2006.01)

(52) U.S. Cl.
CPC .. *B25G 3/02* (2013.01); *B26B 23/00* (2013.01)
USPC ..... 30/308.1; 144/195.5; 144/195.7

(58) Field of Classification Search
USPC ..... 30/308.1, 308.3, 164.5, 164.7, 164.8; 144/195.5, 195.7
See application file for complete search history.

(56) References Cited

U.S. PATENT DOCUMENTS 4,199,016 A 4/1980 Eads et al.
4,294,298 A * 10/1981 Otte, Jr. ..... 144/195.5

(Continued)

FOREIGN PATENT DOCUMENTS

DE 173426 C 7/1906
DE 29902369 U1 6/1999
WO WO 88/00112 * 1/1988
WO 02/062539 A1 8/2002

OTHER PUBLICATIONS

EPO, Supplementary European Search Report in EP 10766704, Sep. 27, 2012.

(Continued)

*Primary Examiner* — Hwei C Payer
(74) *Attorney, Agent, or Firm* — Piedmont Intellectual Property

(57) ABSTRACT

An axe comprising a blade (3) provided with a cutting edge (6) at one end, and a handle (2), and in which the center of gravity of the axe is located at a distance from the cutting edge (6) of the axe and lies in a center-of-gravity plane (C) of the axe located at a distance from a blade plane (B) of the axe parallel with both the center-of-gravity plane (C) and a normal working motion plane (W) of the axe, and in which the cutting edge (6) of the blade and the center of gravity of the axe are arranged to cooperate when the blade (3) hits wood and the cutting edge (6) of the blade partly penetrates into the wood such that at least some of the impact force of the blade (3) is converted into a rotational motion and a motion of the blade (3) in a curvilinear trajectory, the blade (3) is attached to the handle (2) so that the handle (2) is uncircled by the blade (3).

8 Claims, 2 Drawing Sheets

(56) References Cited

U.S. PATENT DOCUMENTS

Figure 1:
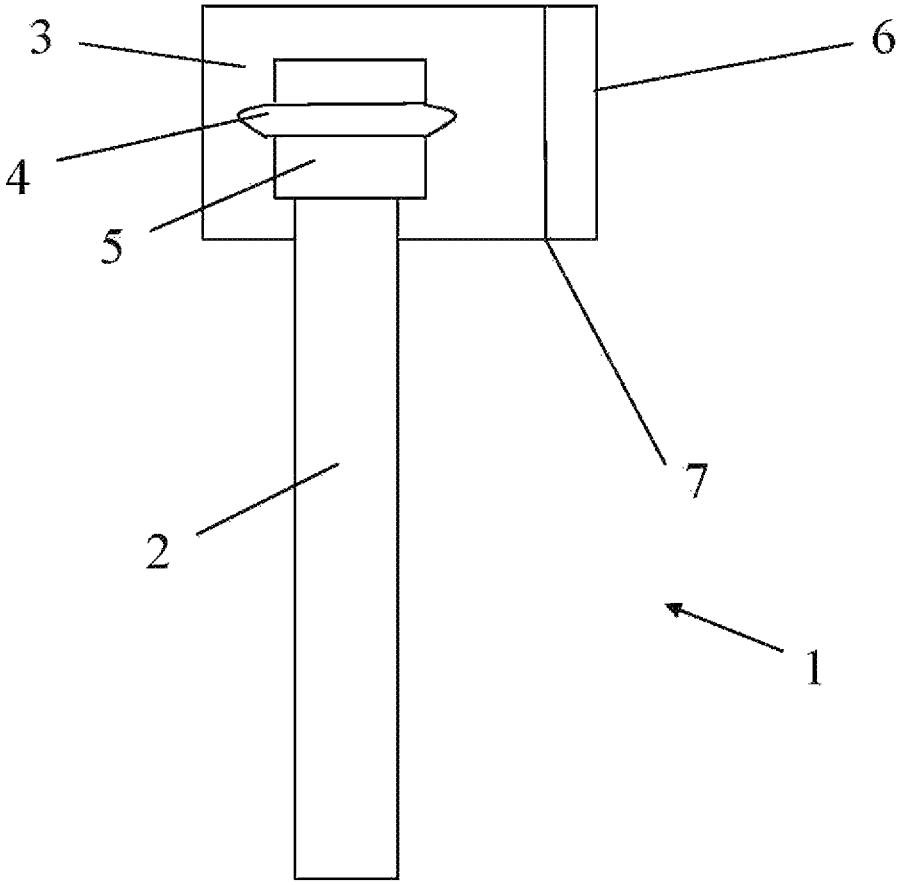

| | | | | | |
|---|---|---|---|---|---|
| 4,300,606 | A | | 11/1981 | Branson | |
| 4,357,974 | A | * | 11/1982 | Nannen | 30/308.1 |
| 4,412,572 | A | * | 11/1983 | Clark | 30/308.1 |
| 4,445,555 | A | * | 5/1984 | Klempirik | 144/195.7 |
| 4,456,044 | A | * | 6/1984 | Cloncs | 144/195.7 |
| 4,522,240 | A | * | 6/1985 | Green et al. | 144/195.8 |
| 4,537,235 | A | | 8/1985 | Aderneck | |
| 4,586,258 | A | | 5/1986 | Burke | |
| 4,817,221 | A | | 4/1989 | Ryan | |
| 5,090,125 | A | | 2/1992 | Sogan | |
| 5,141,353 | A | * | 8/1992 | Meredith et al. | 403/267 |
| 5,152,065 | A | | 10/1992 | Harding | |

OTHER PUBLICATIONS

Natl Board of Patents and Registration of Finland, Intl Search Report in PCT/FI2010/050334, Jul. 9, 2010.

* cited by examiner

AXE

FIELD OF THE INVENTION

The invention relates to an axe.

The invention relates to an axe comprising a blade provided with a cutting edge at one end, and a handle, whereby the centre of gravity of the axe is located at a distance from the cutting edge of the axe and lies in a centre-of-gravity plane of the axe located at a distance from a blade plane of the axe parallel with both the centre-of-gravity plane and a normal working motion plane of the axe, whereby the cutting edge of the blade and the centre of gravity of the axe are arranged to cooperate when the blade hits wood and the cutting edge of the blade partly penetrates into the wood such that at least some of the impact force of the blade is converted into a rotational motion and a motion of the blade in a curvilinear trajectory.

A normal working motion plane of an axe is herein used to refer to a plane in which the axe is moved while splitting wood.

A centre-of-gravity plane is herein used to refer to a plane which is parallel with the normal working motion plane of an axe and which passes through the centre of gravity of the axe.

A blade plane is herein used to refer to a plane which is parallel with the normal working motion plane of an axe and which passes through a cutting edge of a blade.

The normal working motion plane, the blade plane and the centre-of-gravity plane of an axe are parallel with each other and usually vertical.

A conventional axe is symmetric on both sides of the blade plane. Consequently, the centre-of-gravity plane and blade plane of the axe also coincide.

A problem with such a conventional axe is that the only way to affect the splitting force is to make the wedge wider. It is, however, difficult for a blade with a wide wedge to penetrate into the wood. In contrast, a blade with a sharp wedge easily penetrates into the wood but has poor splitting force.

Therefore, a wedge is always a compromise between good penetration and good splitting force. In addition, a disadvantageous characteristic of the conventional axes is that such an axe gets easily stuck in the wood because the axe blade penetrates directly into the wood.

A solution to the problems mentioned above with the conventional axe is disclosed in U.S. Pat. No. 4,300,606, wherefrom an axe according to the preamble of claim 1 is known. The publication discloses an axe head whose blade plane and centre-of-gravity plane are located at a distance from each other, some of the impact force of the axe blade thus being converted into a rotational motion of the axe blade when the blade hits the wood and the cutting edge of the blade partly penetrates into the wood. A rotational motion of the blade makes the wood easier to split.

A problem with this known arrangement is that when the blade hits the wood and the cutting edge of the blade has partly penetrated into the wood and some of the impact force of the blade is converted into a rotational motion, this rotational motion is uncontrolled. After a piece of wood has been cut off from the wood, the blade continues its rotational motion and, in addition to the rotational motion, the blade also continues its travel in a curvilinear trajectory unless the force runs out. Consequently, the axe disclosed in the US publication may even be a dangerous tool for those unaccustomed to using such an axe. The rotational motion of the blade and the motion of the blade in a curvilinear trajectory may result in the user hitting oneself in the foot, for example.

A conventional axe is comprised of two primary components, an axe head i.e. a blade with a cutting edge, and a handle. The blade has a hole, an eye, where the handle is mounted and this interface is secured with small metal or wooden wedges. A conventional axe usually weighs so much that it is not easy to carry along when going for a trek for example. Most of the weight in a conventional axe comes from the blade. The blade is usually drop-forged and made from iron and/or steel.

A problem with the conventional axe is that the blade needs to have a hole where the handle is mounted and producing a hole to the blade is always an expense. Forging as a production method is also quite expensive method and takes time. One important issue also when going for a trek is the weight of the axe. It should not weigh too much. A forged blade is always quite heavy.

BRIEF DESCRIPTION OF THE INVENTION

The object of the invention is thus to provide an axe which alleviates the problems mentioned above.

The object of the invention is achieved by an axe which is characterized in that the blade is attached to the handle so that the handle is uncircled by the blade.

The object of the invention is correspondingly achieved by a method for manufacturing an axe, that comprises a blade provided with a cutting edge at one end, and a handle, whereby the centre of gravity of the axe is located at a distance from the cutting edge of the axe and lies in a centre-of-gravity plane of the axe located at a distance from a blade plane of the axe parallel with both the centre-of-gravity plane and a normal working motion plane of the axe, whereby the cutting edge of the blade and the centre of gravity of the axe are arranged to cooperate when the blade hits wood and the cutting edge of the blade partly penetrates into the wood such that at least some of the impact force of the blade is converted into a rotational motion and a motion of the blade in a curvilinear trajectory characterized in that the axe is manufactured by forming a flat bar steel.

Preferred embodiments of the invention are disclosed in the dependent claims.

The idea of the invention is that the handle is located outside of the blade, advantageously so that the blade does not need to have a hole for the handle to go through. In other words the blade is attached to the handle without the handle penetrating the blade. So the handle is not surrounded by the blade but the handle lies at one side of the blade. In other words the blade is attached to the handle so that the handle is uncircled by the blade. While circle means a path that finishes at its starting point, in this preferred embodiment of the invention the blade do not circle the handle at all but the handle is attached to the side of the blade. The handle may be sited on either side of the blade so that it can be suitable for right-handed or left-handed. In one preferred embodiment of the invention the handle is releasable attached to the blade so that the handedness may be reversed from the right-handedness to the left-handedness or vice versa. In other words the blade is attached releasable to the handle. The blade has a first side and a second side which are connected with a cutting edge of the blade and the first side of the blade is connected to the handle.

The axe handle is most advantageously attached to the side of the blade with a mounting arrangement. The mounting arrangement is preferably a U-bolt or several U-bolts. Also other mounting arrangements than U-bolts are possible. The axe handle can also be attached to the blade with a mounting arrangement such as a bolt or several bolts that go through the handle and the blade. In other words there may be a bolt or several bolts mounting the handle to the blade without having a member surrounding the handle. The screw head is preferably embedded to the blade or to the handle. This means that the blade and handle are side by side and one or several fixing members are going through both of them attaching them to each other. In one embodiment of the invention the handle and the blade are attached to each other by welding them together.

The handle is advantageously made of wood, but it can also be made of plastic, composite or other suitable material. In the case where the mounting arrangement goes through the handle and the blade, it is most advantageous that the handle is made of plastic or composite. The handle has two ends and an elongated portion in which the elongated portion between the two ends has an outer surface. The blade is preferably attached to the outer surface of the handle.

The portion of the handle which is attached to the blade is preferably but not necessarily of a different form than the rest of the handle. The portion of the handle which is attached to the blade is preferably but not necessarily of the shape that borders up inside the mounting arrangement and the blade. The portion of the handle can also be of a different shape, for example rectangular. With the different shape of the portion of the handle attached to the blade the rotation of the handle inside the mounting arrangement is prevented when using the axe. The portion of the handle that is of a different shape than the rest of the handle can restrict in a vertical direction only to the area where the mounting arrangement is but it can also be wider, for example covering the handle all the way to the place where the hands are kept when using the axe. The handle can also be throughout the same shape as in the portion where the blade is attached or it can have only a special portion to the hands.

The portion of the handle which is attached to the blade has preferably but not necessarily a fixing point also with the blade. The blade has a peg which digs to the handle so that the handle stays in place. Also when the handle is made of wood it has preferably but not necessarily a cover in the upper part of the handle so that the handle does not wear when missing the target while splitting wood. The cover can also be larger than the portion of the blade. The cover can also be used when the material of the handle is other than wood. The cover is preferably but not necessarily made of plastic. In one preferred embodiment the handle is releasable attached to the blade. That way it is easy to carry along.

The other idea of the invention is that the blade is made preferably with a bending machine, an edging press, a sheet metal work station or other suitable machine. The material from which the blade is made is preferably a flat bar steel, a sheet metal or other material which is suitable for bending and/or folding. The material is bent or folded to the shape wanted and in order to have an effective manufacturing process the flat bar steel or other can be cut after bending to be a single blade. Bending or folding can also be done to a single blade material. In a preferred embodiment of the invention the blade is made by pressing. After being pressed, bent or folded to the desired shape the cutting edge of the blade is sharpened for example with a milling machine or with other suitable machine. The cutting edge of the blade can also be sharpened to be saw-edged or saw-toothed. The blade can also be made by casting it from metal.

The blade is equipped with a first stop element that is preferably on the opposite side to the blade plane on which the centre of gravity of the axe lies. The first stop element is located at a distance from the cutting edge of the blade. The first stop element is arranged to stop the blade from penetrating too deeply into the wood and thus to help the rotational motion of the blade to get started. The first stop element stops the side of the axe blade that is located on the opposite side of the blade plane of the axe with respect to the centre of gravity of the axe, which means that the motion of the "heavier side" of the axe continues and a rotational motion is achieved. The blade of the axe has also preferably a second stop element on the side of the blade plane of the axe on which the centre of gravity of the axe lies. The second stop element is arranged to hit the wood during the rotational motion of the blade and the motion of the blade in curvilinear trajectory. The rotational motion of the blade and the motion of the blade in a curvilinear trajectory automatically stop completely or at least automatically slow down when the second stop element hits the wood. The second stop element may also be equipped with extra weighs that are preferably releasable attached to it. All the embodiments of the blade can be manufactured with a bending machine, an edging press, a sheet metal work station or other suitable machine.

One further idea of the invention is that the axe fits to a small place so that it can be easily taken along when for example going for a trek and for this purpose it is convenient that the axe's second stop element is arranged to have a hinge so that the second stop element is hinged with a turning joint. When having a turning joint in the second stop element the axe needs smaller space for instance in the backpack.

One further embodiment of the axe is that the axe can be equipped with at least one weight to move the centre of gravity of the axe with respect to the blade plane. That way it helps the motion of the axe to be a rotational motion when the blade hits the wood and the cutting edge partly penetrates into the wood. The extra weight is preferably detachable.

LIST OF DRAWINGS

Figure 2:
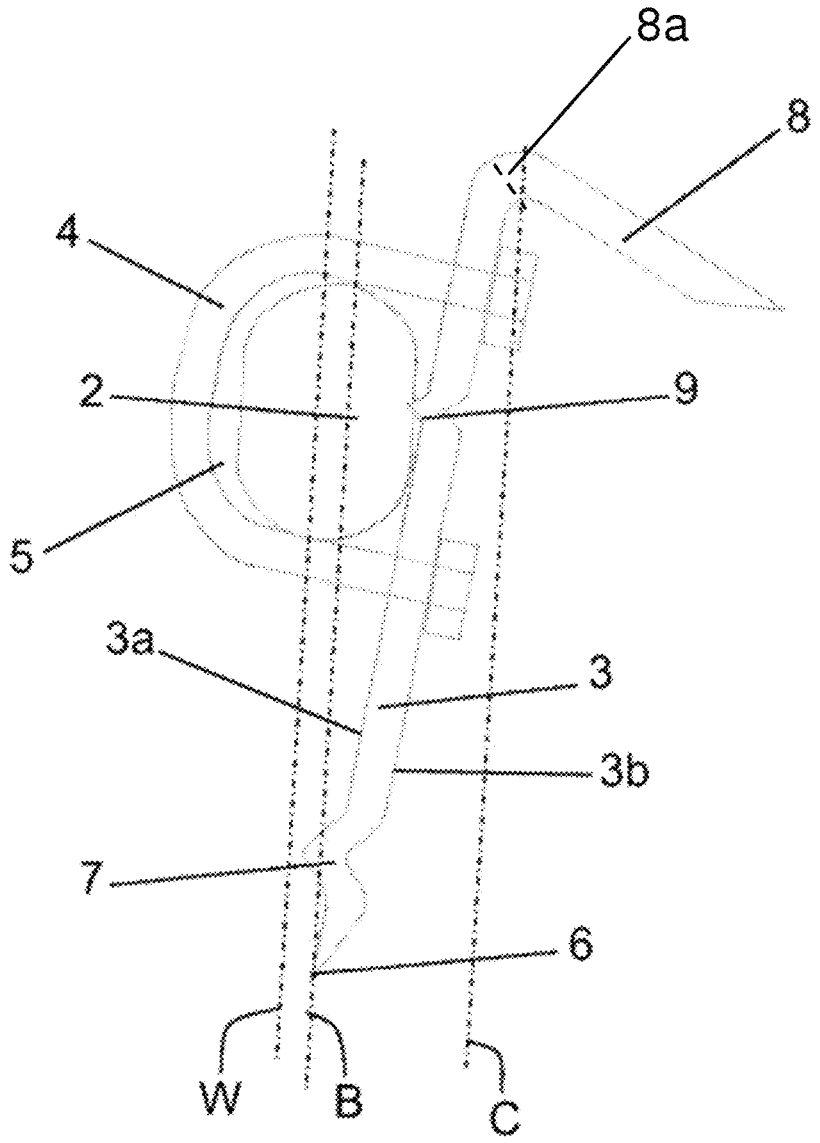

The invention is now described in closer detail in connection with the preferred embodiments and with reference to the accompanying drawings, in which FIG. 1 shows an axe according to the invention, and FIG. 2 shows in more detail the axe according to the invention.

DETAILED DESCRIPTION OF THE INVENTION

The FIG. 1 shows an axe 1 that comprises a handle 2 which the handle 2 is attached to the blade 3 with a mounting arrangement 4. The mounting arrangement 4 may also be other than shown in the figure, for example a bolt or several bolts going through the handle and the blade. In this embodiment of the invention the mounting arrangement 4 is a U-bolt. In this preferred embodiment of the invention the portion 5 of the handle 2 attached to the blade 3 is of a different shape than the rest of the handle 2. The blade 3 has a cutting edge 6, a first stop element 7 and a second stop element (not shown in the figure). The portion 5 of the handle 2 which is of a different shape than the rest of the handle is preferably covered with a plastic material or having a plastic sleeve which protects the handle from wearing. The sleeve or the covering may preferably extend to the lower part of the handle too so that all the parts that may hit the wood when missing the target while splitting the wood will be protected from wearing. The portion of the handle 5 attached to the blade may also be of the same shape than the rest of the handle and still having the sleeve or the covering.

The FIG. 2 shows a top view of the axe 1 seen in FIG. 1. The blade 3 has a first side 3 *a* and a second side 3*b* which are connected with a cutting edge 6 of the blade 3 and the first side 3 *a* of the blade 3 is connected to the handle. The axe 1 having a handle 2 where the user keeps his hands while splitting wood. The portion 5 of the handle 2 that is attached to the blade 3 is attached to the first side 3*a* of the blade 3 with a mounting arrangement 4 and with a fixing point 9. The fixing point 9 is preferably bent from the blade material or there can be a separate fixing means, too, for example a staple or a nail. The mounting arrangement 4 is preferably attached to the blade so that the screw head is embedded to the blade 3 to be at the same level as the blade surface. The blade 3 has a cutting edge 6, a first stop element 7 and a second stop element 8. Both stop elements are bent from the same material as the blade. The second stop element 8 may be equipped with a hinge 8*a* (illustrated schematically by a dashed line in FIG. 2) and/or extra weights. The cutting edge 6 of the blade is sharpened with a milling machine or other suitable machine. The cutting edge 6 can also be saw-edged or saw-toothed. A plastic cover or a sleeve may be placed between the handle and the mounting arrangement to prevent the handle from wearing. When the sleeve is placed to the handle, the sleeve is preferably warm so that it is easier to put on.

The figure also shows the centre of gravity plane C of the axe where the weight of the axe is distributed. The centre of gravity plane C of the axe is located at a distance from the cutting edge 6 of the blade 3. The position of the centre of gravity plane C of the axe depends on the material of which the axe is made. The blade plane B goes through the cutting edge 6 of the blade 3 and is parallel to the normal working motion plane W. The blade plane B, the normal working motion plane W and the centre of gravity plane C are all considered to be parallel.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. An axe comprising:

a blade head, having a first side and a second side connected with a cutting edge at one end, and a handle, wherein a center of gravity of the axe is located at a distance from the cutting edge and lies in a center-of-gravity plane of the axe located at a distance from a blade plane of the axe parallel to both the center-of-gravity plane and a normal-working-motion plane of the axe, the cutting edge and the center of gravity are arranged to cooperate when the blade hits wood and the cutting edge partly penetrates into the wood such that at least some of an impact force of the blade head is converted into a rotational motion and a motion of the blade head in a curvilinear trajectory, the first side of the blade head is attached to the handle so that the handle is unencircled by the blade head, and the blade head is made of flat bar steel;

wherein on a side of the blade plane on which the center of gravity of the axe lies, the axe has a first stop element arranged to hit the wood during the rotational motion of the blade head and the motion of the blade head in a curvilinear trajectory, and the first stop element is disposed at the free end of the blade head opposite the cutting edge.

2. The axe of claim 1, wherein on an opposite side to the blade plane on which the center of gravity lies, the blade head has a second stop element located at a distance from the cutting edge, and the second stop element is arranged to limit blade head penetration into the wood before the rotational motion starts.

3. The axe of claim 1, wherein the first stop element is provided at the free end of the blade head of the axe.

4. The axe of claim 1, wherein the first stop element is arranged to have a hinge.

5. the axe of claim 1, wherein the blade head is releasably attached to the handle.

6. The axe of claim 1, wherein the handle is attached with a mounting arrangement.

7. The axe of claim 1, wherein the blade head is made by pressing.

8. The axe claim 1, wherein the cutting edge is saw-toothed.

* * * * *